US008496448B2

(12) United States Patent
Shieh et al.

(10) Patent No.: US 8,496,448 B2
(45) Date of Patent: Jul. 30, 2013

(54) PUMP ASSEMBLY

(75) Inventors: Tenghua Tom Shieh, Ann Arbor, MI (US); Kyle Thomas Bernier, Clarkston, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 282 days.

(21) Appl. No.: 12/725,220

(22) Filed: Mar. 16, 2010

(65) Prior Publication Data

US 2011/0229357 A1 Sep. 22, 2011

(51) Int. Cl.
*F04B 39/02* (2006.01)
*F04B 39/06* (2006.01)

(52) U.S. Cl.
USPC ..... 417/370; 417/366

(58) Field of Classification Search
USPC ..... 417/423.1, 423.14, 366, 368, 369, 417/370; 416/223 R
See application file for complete search history.

(56) References Cited

U.S. PATENT DOCUMENTS

| | | | | | |
|---|---|---|---|---|---|
| 2,120,914 | A | * | 6/1938 | Vogel | 310/54 |
| 2,301,063 | A | * | 11/1942 | McConaghy | 417/370 |
| 2,520,880 | A | * | 8/1950 | Harlamoff | 417/370 |
| 2,741,990 | A | * | 4/1956 | White | 417/357 |
| 2,810,348 | A | * | 10/1957 | White | 417/357 |
| 2,913,988 | A | * | 11/1959 | White | 417/357 |
| 3,220,350 | A | * | 11/1965 | White | 417/357 |
| 3,223,043 | A | * | 12/1965 | Shapiro | 417/370 |
| 3,225,698 | A | * | 12/1965 | Spisiak | 417/369 |
| 3,318,253 | A | * | 5/1967 | Campolong | 417/367 |
| 3,426,691 | A | * | 2/1969 | Anderson | 417/370 |
| 3,572,976 | A | * | 3/1971 | Sato | 417/369 |
| 3,936,240 | A | * | 2/1976 | Dochterman | 417/368 |
| 4,019,829 | A | | 4/1977 | Knopfel et al. | |
| 4,155,333 | A | | 5/1979 | Maggiorana | |
| 4,349,322 | A | * | 9/1982 | Stahle | 417/370 |
| 4,523,900 | A | * | 6/1985 | Frey | 417/365 |
| 4,616,980 | A | * | 10/1986 | Carpenter | 417/357 |
| 4,642,030 | A | * | 2/1987 | Friebe et al. | 417/203 |
| 4,684,329 | A | * | 8/1987 | Hashimoto | 417/357 |
| 4,913,620 | A | | 4/1990 | Kusiak et al. | |
| 4,958,988 | A | * | 9/1990 | Regev | 417/53 |
| 4,961,404 | A | | 10/1990 | Itakura et al. | |
| 4,999,994 | A | | 3/1991 | Rud et al. | |
| 5,049,770 | A | | 9/1991 | Gaeth et al. | |
| 5,275,538 | A | | 1/1994 | Paliwoda et al. | |
| 5,288,213 | A | * | 2/1994 | Nasr | 417/368 |

(Continued)

FOREIGN PATENT DOCUMENTS

WO WO-2008153720 A1 12/2008

*Primary Examiner* — Charles Freay
*Assistant Examiner* — Alexander Comley
(74) *Attorney, Agent, or Firm* — Gifford, Krass, Sprinkle, Anderson & Citkowski, P.C.

(57) ABSTRACT

The present invention provides a pump assembly having an intake, an outtake, and a rotor rotatably mounted to a shaft. A propeller is fixedly mounted to the upstream portion of the rotor and is rotatable upon actuation of the rotor. A passageway is disposed on the rotor so as to provide a path for fluids to cool the shaft. The pump assembly includes chamber and a pipe. The chamber is disposed within the housing and is located downstream the intake and is in communication with the passageway. The pipe interconnects the chamber with the outtake. An impeller is fixedly mounted to the rotor opposite the propeller and draws air bubbles from the passageway into the chamber.

11 Claims, 3 Drawing Sheets

U.S. PATENT DOCUMENTS 5,397,220 A * 3/1995 Akihisa et al. ..... 417/369
5,405,251 A * 4/1995 Sipin ..... 417/420
5,624,244 A * 4/1997 Moon ..... 417/366
5,890,880 A * 4/1999 Lustwerk ..... 417/366
5,997,261 A * 12/1999 Kershaw et al. ..... 417/366
6,012,909 A * 1/2000 Sloteman et al. ..... 417/366
6,139,274 A 10/2000 Heer
6,142,748 A * 11/2000 Harris et al. ..... 417/313
6,174,143 B1 * 1/2001 Horski et al. ..... 417/366
6,267,554 B1 7/2001 Heer
6,394,423 B1 5/2002 Vento
6,454,541 B1 * 9/2002 Ijiri et al. ..... 417/53
6,732,680 B1 5/2004 Beltramo et al.
6,863,035 B2 3/2005 Komorowski
6,892,844 B2 5/2005 Atsuumi
7,047,914 B2 5/2006 Komorowski
7,156,617 B2 1/2007 Rossman
7,160,086 B2 * 1/2007 Maceyka et al. ..... 417/368
7,299,616 B2 11/2007 Filippone
2001/0043871 A1 * 11/2001 Rennett et al. ..... 417/368
2007/0063594 A1 * 3/2007 Huynh ..... 310/59
2008/0304986 A1 * 12/2008 Kenyon et al. ..... 417/423.12
2009/0202366 A1 * 8/2009 Geisinger et al. ..... 417/366

* cited by examiner

PUMP ASSEMBLY

FIELD OF THE INVENTION

The present invention relates generally to a pump assembly for circulating fluids. More specifically the pump assembly includes a pipe and an impeller operable to draw air bubbles from the shaft of the pump assembly to the outtake.

BACKGROUND OF THE INVENTION

Pump assemblies include an intake, an outtake, and a motor operable to drive a propeller so as to circulate fluids through a system. Pump assemblies are commonly attached to a conduit interconnecting the intake to the outtake so as to form a closed system. Many pumps use an electric drive such as a magnet and stator for turning the propeller.

The magnet is housed in the rotor. The rotor includes an inner peripheral wall encircling a shaft. Fluids are delivered to the surface of the shaft so as to provide lubrication for facilitating rotation of the rotor. It is also known to form a passageway on the inner peripheral wall of the rotor so as to provide a passageway in communication with the shaft. The passageway extends between the intake and the outtake. The passageway provides a path for fluids which flow along the shaft so as to help cool the pump and maintain the pump at an optimal operating temperature.

However, rotation of the propeller creates air bubbles in the fluids and in some cases these air bubbles are sucked through the passageway. In certain operating conditions there is insufficient pressure at the outtake and bubbles are entrapped in the passageway. Thus, fluid is not circulated along the outer surface of the shaft and the rotor can seize as the operating temperature of the shaft increases or alternatively corrosion sets in.

Accordingly, it remains desirable to have a pump assembly that can draw the air from the shaft so as to maintain flow of the fluid along the outer surface of the shaft under various operating conditions of the pump. It also remains desirable to have a pump assembly having an impeller operable to draw air bubbles from the shaft that is actuated by the same drive actuating the propeller.

SUMMARY OF THE PRESENT INVENTION

The present invention provides a pump assembly which overcomes the above-mentioned disadvantages. The pump assembly includes a housing having an intake and an outtake. A shaft is disposed within the housing. The pump assembly further includes a rotor disposed within the pump assembly housing. The rotor has an inner peripheral wall defining a bore. The rotor is rotatably mounted to the shaft. A stator is operative to actuate the magnet so as to rotate the rotor.

A propeller is fixedly mounted to the upstream portion of the rotor housing and is rotatable upon actuation of the rotor. A passageway is disposed on the inner peripheral wall and extends between the intake and the outtake so as to provide a path for fluids. The fluids travel along the outer surface of the shaft and are circulated within the closed system so as to help maintain the pump assembly at a predetermined operating temperature.

The pump assembly further includes chamber and a pipe. The chamber is disposed within the housing and is located downstream the intake. The chamber is elevated with respect to the shaft and is in communication with the passageway. The pipe interconnects the chamber with the outtake. Thus outgoing fluid creates a pressure differential between the outtake and the intake wherein the vacuum draws air from within the passageway into the chamber and further into the outtake.

The pump assembly may further include an impeller. The impeller is fixedly mounted to the rotor and is opposite the propeller. Accordingly, the impeller is actuated by the same drive mechanism as the propeller. The impeller is in communication with the chamber. In operation the impeller creates a centrifugal force that draws air bubbles and fluids traveling along the passageway out into the chamber.

The buoyancy of the air bubbles causes the air bubbles to rise to the upper portion of the chamber and into the mouth of the pipe. Outgoing fluid creates a vacuum so as to draw these air bubbles into the outtake. Thus the present invention provides an impeller and a pipe for drawing air bubbles disposed within the passageway of the rotor housing into the outtake of the pump assembly.

BRIEF DESCRIPTION OF THE DRAWING

A better understanding of the present invention will be had upon reference to the following detailed description when read in conjunction with the accompany drawing wherein like reference characters refer to like parts throughout the several views and in which.

DETAILED DESCRIPTION OF THE INVENTION

Figure 1:
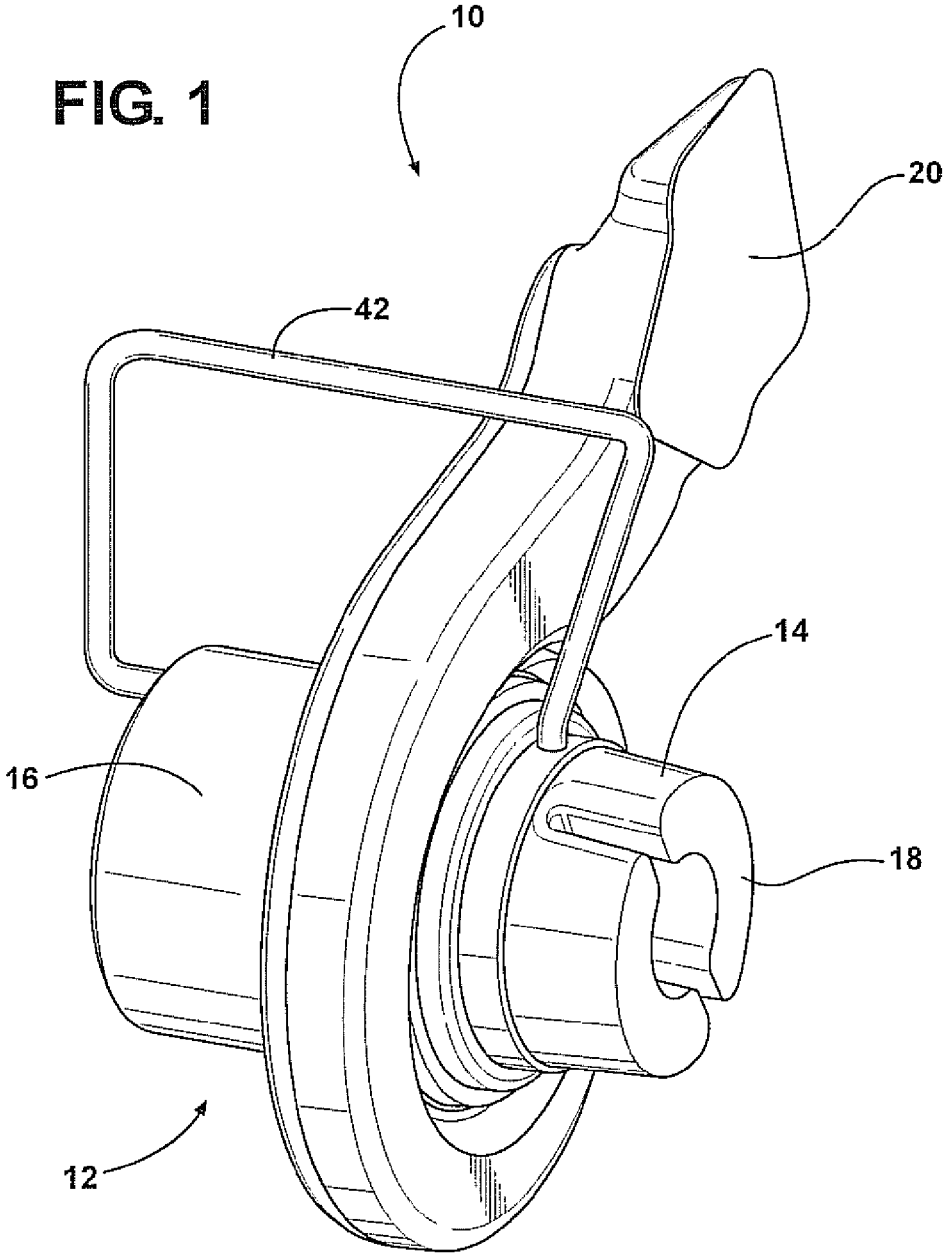
FIG. 1 is a perspective view of the pump assembly showing the housing, pipe, the intake, and the outtake.

With reference first to FIG. 1, a pump assembly 10 of the present invention is provided. The pump assembly 10 is operable to circulate fluids through a conduit (not shown). The conduit may be in communication with an engine (not shown) and the pump is operable to circulate fluids through the conduit so as to help maintain a desired operating temperature of the engine.

The pump assembly 10 has a housing 12. The housing 12 may be formed of material operable to maintain its form when subjected to a temperature between approximately 80 to 90 degrees Celsius. Such material is currently known and used in the art and illustratively includes metal or a plastic composite. The housing 12 includes a first portion 14 and a second portion 16. The housing 12 further includes an intake 18 and an outtake 20 for circulating fluids through the conduit. The intake 18 and the outtake 20 are disposed within the first portion 14 of the housing 12.

The pump assembly 10 further includes a shaft 22 fixedly disposed within the housing 12 and a rotor 24 operatively mounted within the housing 12. The shaft 22 is an elongated member extending axially through the rotor 24. The shaft 22 may be formed of a rigid and durable material having sufficient strength to support the rotor 24. Such a material is currently known and used and includes a metal such as steel, or a steel composite.

The rotor 24 has an inner peripheral wall 26 defining a bore 28. The shaft 22 is inserted through the bore 28 and is in sliding contact with the inner peripheral wall 26 of the rotor 24. More specifically, the rotor 24 is operable to rotate around the shaft 22.

The rotor 24 includes an upstream portion 30, a downstream portion 32, and a neck portion 34 interconnecting the downstream portion 32 to the upstream portion 30. The rotor 24 further includes a magnet 36 and a propeller 38. The magnet is disposed within the downstream portion 32 of the rotor 24. The propeller 38 is fixedly mounted to the distal end of the upstream portion 30 of the rotor 24. The downstream portion 32 of the rotor 24 is disposed within the second portion 16 of the housing 12. The upstream portion 30 of the rotor 24 is disposed within the first portion 14 of the housing 12.

The pump assembly 10 further includes a stator 40. The stator 40 is disposed within the second portion 16 of the housing 12 and is operatively connected to the magnet 36 so as to rotate the propeller 38. Any magnet 36 and stator 40 currently known and used in the art is suitable for use herein.

The pump assembly 10 further includes a pipe 42 interconnecting a portion of the housing 12 to the outtake 20. The pipe 42 enclosing a volume so as to promote fluid and air bubble flow from the housing 12 to the outtake 20. The pipe 42 provides a passage for fluids and air bubbles to move from the bore 28 of the rotor 24 to the outtake 20 so as to facilitate the circulation of fluids along the outer surface of the shaft 22. The fluids and air bubbles may then be mixed with the fluids in the outtake 20.

Figure 2:
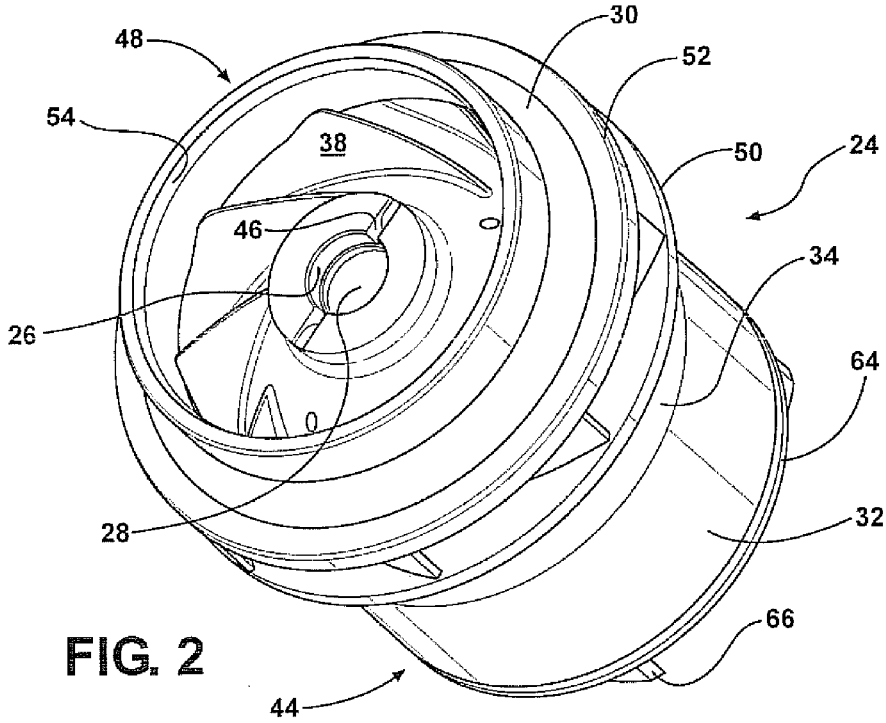
FIG. 2 is a perspective view of the rotor showing the propeller.

With reference now to FIG. 2, a perspective view of the rotor 24 is shown. The rotor 24 has a generally cylindrical body 44. The bore 28 extends through the upstream, neck, downstream portions 30, 34, 32 of the cylindrical body 44. The inner peripheral wall 26 of the rotor 24 further includes a passageway 46. The passageway 46 extends axially along the inner peripheral wall 26 and between opposing ends of the rotor 24. The passageway 46 extends between the intake 18 and outtake 20 so as to provide a path for fluids. The passageway 46 includes a first portion 46*a*. The first portion 46*a* extends axially along the shaft 22. The first portion 46*a* includes a distal end 46*b* opposite a proximal end 46*c*. The proximal end 46*c* is positioned at the intake so as receive a portion of the fluid from the intake 18. The upstream portion 30 includes a head cover 48 having a support wall 50 spaced apart from a head cover base 52, and a collar 54. The support wall 50 extends radially from the body of the rotor 24.

Preferably the rotor 24 includes a plurality of propellers 38 spaced equally apart from each other. The propellers 38 are disposed on the support wall 50 and extend radially from the bore 28 to the outer peripheral edge of the support wall 50. The propellers 38 are generally elongated members and may be integrally formed to the support wall 50. The propellers 38 are also generally ramp shaped, meaning the outer surface edge of the propellers 38 is angled relative to the planar surface of the support wall 50. The propellers 38 are further disposed between the intake and the outtake. The propellers are operable to eject water from the intake 18 into the outtake 20 so as to circulate fluids through the conduit.

The head cover base 52 includes an engaging surface 56 having notches 58 configured to receive respective outer surface edges of each propeller 38. The propellers 38 are seated within respective notches 58 so as to be disposed between the head cover base 52 and the support wall 50. The head cover 48 further includes a collar 54. The collar 54 is disposed on the head cover base 52 and is operable to guide fluids and direct them into the propeller 38.

Figure 3:
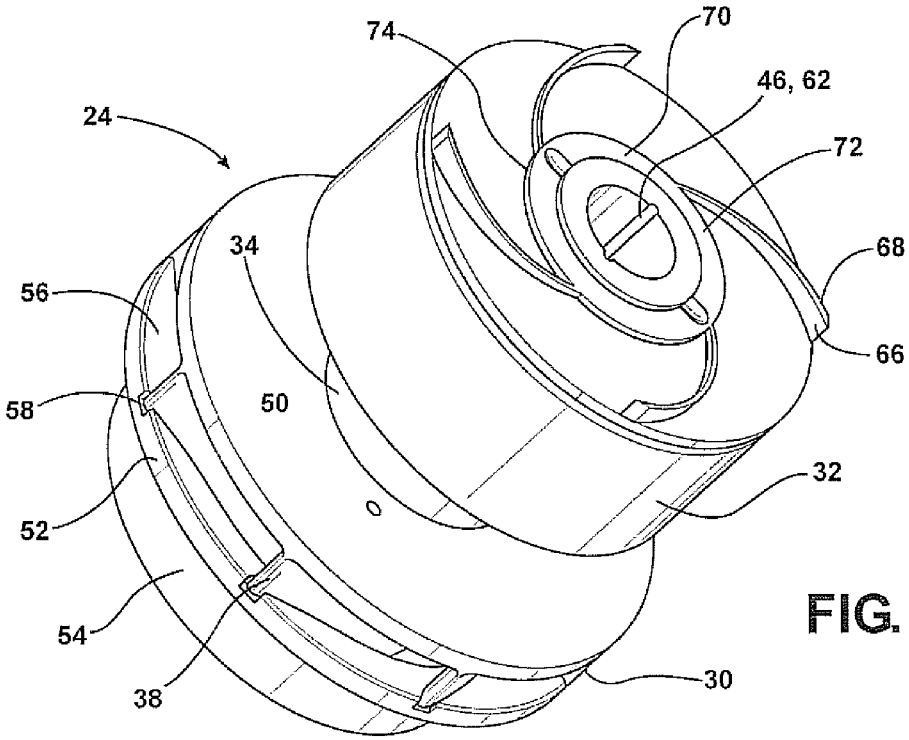
FIG. 3 is a perspective view of the rotor showing the impeller.

With reference now to FIG. 3, the downstream portion 32 of the rotor 24 is illustrated. The bore 28 includes a pair of spaced apart and opposing passageways 46 disposed on the inner peripheral wall 26 of the rotor 24. Each passageway 46 extends axially between the intake 18 and the outtake 20 and provides a path for fluids.

The shaft 22 (not shown) is configured to slidingly engage the inner peripheral wall 26. More specifically, actuation of the stator and magnet rotates the rotor about the shaft. The passageway 46 is in communication with the shaft 22 such that operation of the rotor 24 pushes fluid along the outer surface of the shaft 22 so as to help maintain a desired operating temperature of the pump assembly 10. Preferably, the passageway 46 is a groove 60 formed along the inner peripheral wall 26 and extending axially from the upstream portion 30 of the rotor 24 to the downstream portion 32 of the rotor 24.

The downstream portion 32 of the rotor 24 is also generally cylindrical and has a radius less than that of the upstream portion 30. The downstream portion 32 includes an end plate 62 disposed on the distal end of the cylindrical body 44. The end plate 62 may be formed of a durable material such as steel or other like material. The end plate 62 has a generally planar surface disposed along a plane generally orthogonal to the axis of the shaft 22. The end plate 62 may include an impeller 64 fixedly mounted onto the end plate 62 so as to be opposite the propeller 38.

The impeller 64 extends generally radially from the bore 28. The impeller 64 is an elongated and arcuate member and is disposed the end plate 62. Alternatively, the impeller 64 may be integrally formed to the distal end of the downstream portion 32 of the rotor 24. The impeller 64 includes an upper edge surface 66 extending between opposing ends of the impeller 64. One end of the upper edge surface 66 of the impeller 64 is displaced further from the plate than the other end of the upper surface of the impeller 64 so as to form a generally ramp shaped elongated and arcuate member. The impeller 64 extends arcuately so as to curve in the same rotational direction of the rotor 24 thus creating a centrifugal force so as to draw fluids and air bubbles out of the passageway 46 of the rotor 24.

The lower portion of the housing 12 may further include a hub 68. The hub 68 is mounted to the end plate of the rotor 24. The hub 68 has a hub surface 70. The hub surface 70 is displaced from the rotor 24 so as to define a predetermined hub width 72, and the impeller 64 may be integrally formed to the hub 68. Preferably the upper edge surface 66 of one end of the impeller 64 is contiguous with the hub surface 70 so as to be disposed along the same plane as the hub surface 70 and the opposite end of the upper surface of the impeller 64 is disposed along a plane that is displaced from the plane of the hub surface 70. Though FIG. 3 shows the pump assembly 10 having four impellers 64 equally spaced apart from each other, it is anticipated that the pump assembly 10 may include just one impeller 64. It should be understood by those skilled in the art that the number of impellers 64 is a matter of design choice and engineering specifications.

Preferably the impellers 64 are formed out of metal. The arcuate shape of the impellers 64 is designed to create a centrifugal force so as to further draw fluids and air bubbles from the passageway 46 and to facilitate circulation of fluids and thus the cooling of the pump assembly 10. The distal ends of the impellers 64 are disposed within the outer peripheral edge of the rotor 24 so as to be free of the housing during rotation.

Figure 4:
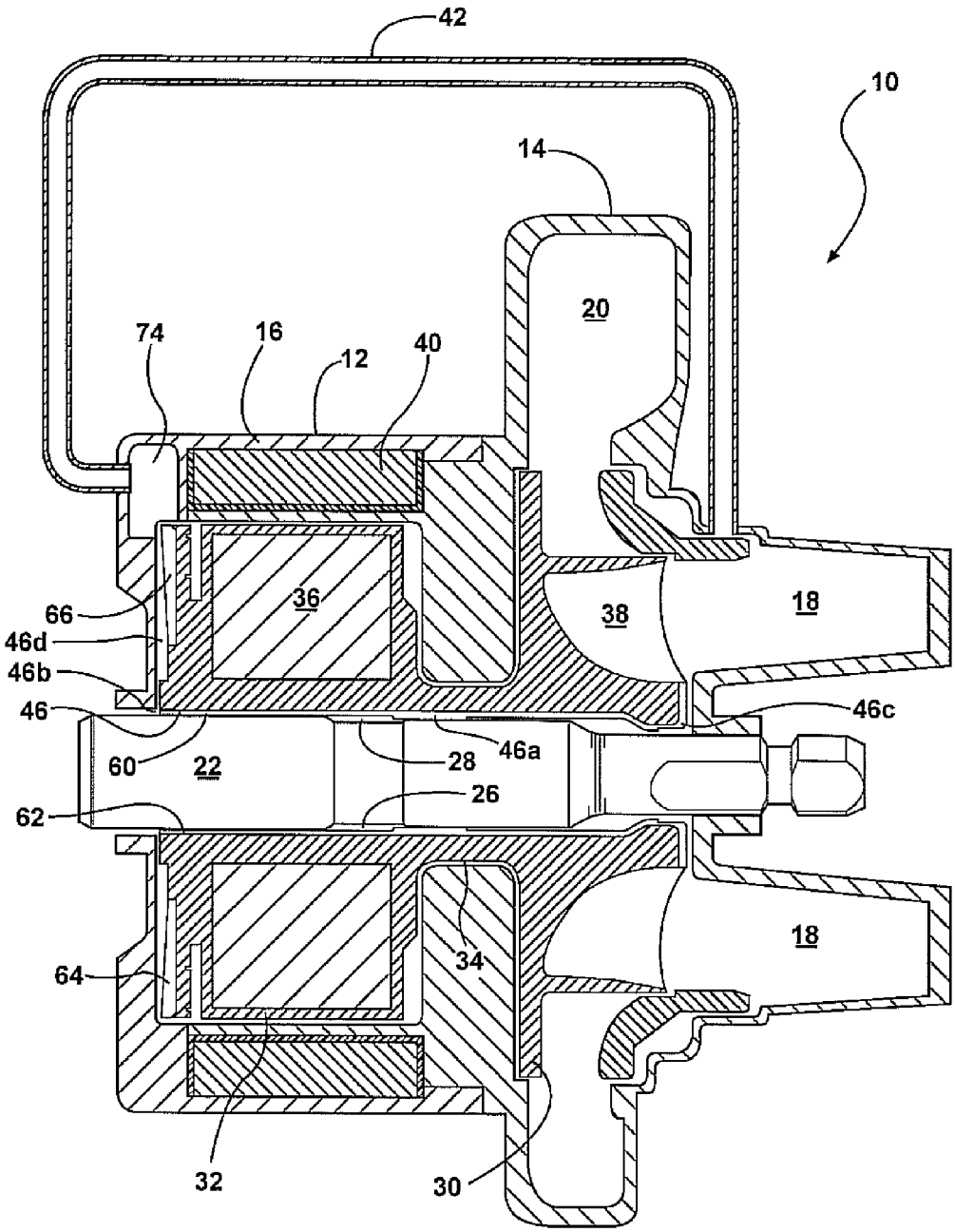
FIG. 4 is a cross section of FIG. 1.

With reference now to FIG. 4, a cross section of FIG. 1 is provided. The pump assembly 10 housing 12 further includes a chamber 74. The chamber 74 is disposed within the housing 12 and is located downstream the intake 18. More specifically, the chamber 74 is disposed between the distal end of the downstream portion of the rotor 24 and the distal end of the second portion of the pump assembly 10 housing 12. The portion of the chamber 74 is elevated with respect to the shaft 22 and is in communication with the passageway 46. The chamber 74 is disposed within the housing 12. spaced apart the propeller 38 and downstream the intake 18. The passageway 46 further includes a second portion 46*d*. The second portion 46*d* of the passageway 46 extends radially from the distal end 46*b* of the first portion 46*a* so as to place the first portion 46*a* in fluid communication with the chamber 74. Specifically, the fluid from the proximal end 46*c* of the first portion 46*a* is passed downstream to the distal end 46*b*, through the second portion 46*d* to the chamber 74. The pipe 42 interconnects the chamber 74 with the outtake 20. Thus outgoing fluid from the outtake 20 creates a vacuum so as to draw air within the passageway 46 into the chamber 74 and further into the outtake 20.

In operation the pump assembly 10 draws air bubbles and fluids from the passageway 46 of the inner peripheral wall 26 of the rotor 24 into the chamber 74 and out into the outtake 20. Thus, pressure from outgoing fluids draws fluids and air bubbles through the pipe 42 and the chamber 74 so as to maintain circulation of fluids along the passageway 46 and maintain the pump assembly 10 at a desired operating temperature. The fluids and air bubbles from the passageway 46 are then introduced and mixed with outgoing fluids in the outtake 20.

The pump assembly 10 is actuated by sending an electrical signal to the stator 40 so as to produce a constantly rotating magnetic field, which in turn induces a magnetic field in the magnet 36 that opposes the magnetic field of the stator 40. As the two fields repel each other, the rotor 24 is rotated about the fixed shaft 22. Rotation of the rotor 24 rotates the fixed propellers 38 creating a force ejecting water from the intake 18 into the outtake 20.

Naturally, the rotation of the propeller 38 creates turbulence and thus air bubbles may be formed. In addition to fluids, air bubbles may also be drawn into the passageway 46 so as to flow along the outer surface of the shaft 22. The fluids lubricate the shaft 22 and helps maintain the desired operating temperature of the pump assembly 10. However, the air bubbles if entrapped in the passageway 46 may facilitate corrosion and thus cause the pump assembly 10 to fail. Additionally, the lack of fluid circulation along the passageway 46 may cause the pump assembly 10 to reach a temperature resulting in pump assembly failure.

As the rotor 24 is being rotated, the impellers 64 create a centrifugal force further drawing the fluids out of the passageway 46 and into the chamber 74. As the fluids are drawn, air bubbles are also being drawn. Once the air bubbles exit the passageway 46, the buoyancy of the air bubbles causes the air bubbles to rise into the chamber 74 and into the pipe 42. Preferably, the pipe 42 is disposed at the upper end portion of the housing 12 so as to take advantage of the buoyancy of the air bubbles. As the air bubbles enter to the upper portion of the chamber 74 the air bubbles come into communication with the pipe 42 wherein vacuum from the outgoing fluids draws the air bubbles from the chamber 74 into the outtake 20.

It should be appreciated by those skilled in the art that the impeller 64 is not necessary to draw the fluids and air bubbles from the passageway 46 into the chamber 74 when the pressure from outgoing fluids creates a sufficient pressure differential to draw fluids from the passageway 46. For instance, the stator 40 and magnet 36 may be actuated to rotate the rotor 24 at maximum revolutions per minute, and thus maximum pressure is created at the outtake 20 which is sufficient to draw fluids from the passageway 46 into the chamber 74. However, reducing the rotational speed of the rotor 24 will cause the pressure on the outtake 20 to drop to a point where the pressure on the outtake 20 is equal to the pressure experienced within the passageway 46 of the rotor 24. Thus, no pressure differential is created between the passageway and the outtake. In cases where there is no pressure differential between the outtake 20 and the passageway 46 there is insufficient pressure to draw fluids from the passageway 46. Thus air bubbles may be entrapped within the passageway 46.

However in a preferred embodiment the rotor 24 includes the impeller 64. The impeller is fixed to the rotor and thus rotates any time the stator is actuated. The impellers are configured to push fluids radially away from the bore so as to create a centrifugal force. Thus, any time the rotor 24 is actuated fluids are drawn from the passageway 46 under all operating conditions. Accordingly, the present invention provides a system for drawing air bubbles and fluids in the passageway 46 of the rotor 24 that utilizes only one drive to actuate both the propeller 38 and to draw the fluids and air bubbles.

Obviously, many modifications and variations of the present invention are possible in light of the above teachings and may be practiced otherwise than as specifically described while within the scope of the appended claims. In addition, the reference numerals in the specification are merely for convenience and are not to be read in any way as limiting.

We claim:

1. A pump assembly for circulating fluids, the pump assembly having a housing including an intake and an outtake, a shaft disposed within the housing, and a rotor, the rotor having an inner peripheral wall encircling the shaft so as to define a bore, the rotor actuated by a magnet disposed within the housing, a propeller fixedly mounted to an upstream portion of the rotor and a stator operatively connected to the magnet so as to rotate the propeller, the pump assembly comprising:

a passageway extending between the intake and outtake so as to provide a path for fluids, a first portion of the passageway, the first portion having a proximal end positioned at the intake for intaking a portion of the fluid, the first portion of the passageway extending axially along the shaft; and a chamber disposed within the housing and spaced apart the propeller and downstream the intake, the chamber is completely elevated with respect to the shaft, a second portion of the passageway extending radially from the first portion so as to place the first portion in fluid communication with the chamber, the passageway further including a pipe disposed external to the housing and interconnecting the chamber with the outtake, wherein a first end of the pipe is disposed on an upper portion of the chamber, wherein outgoing fluid creates a vacuum so as to draw air within the passageway into the chamber, the air travelling to the upper portion of the chamber through buoyancy and further into the outtake.

2. The pump assembly as set forth in claim 1, wherein the passageway is a groove.

3. The pump assembly as set forth in claim 1, further including an impeller fixedly mounted to the rotor and opposite the propeller, the impeller in communication with the chamber.

4. The pump assembly as set forth in claim 3, wherein the impeller extends radially from the bore.

5. The pump assembly as set forth in claim 3, wherein the impeller is an elongated and arcuate member disposed on a plane generally orthogonal to a longitudinal axis of the shaft.

6. The pump assembly as set forth in claim 5, wherein the impeller curves in the same rotational direction rotor so as to create a centrifugal force upon rotation of the rotor.

7. The pump assembly as set forth in claim 3, wherein the impeller includes an upper surface extending between opposing ends, and wherein one end of the upper surface of the impeller is displaced further from the rotor than on the other end of the upper surface of impeller.

8. The pump assembly as set forth in claim 3, further including a hub mounted to the rotor, the hub having a hub surface, the hub surface displaced from the rotor so as to define a predetermined hub width, and wherein the impeller is fixedly mounted to the hub.

9. The pump assembly as set forth in claim 8, wherein the impeller includes an upper surface extending between opposing ends, one wherein one end of the upper surface of the impeller is disposed along the same plane as the hub surface and the other end of the upper surface of the impeller is disposed along a plane displaced from the hub surface.

10. The pump assembly as set forth in claim 3, wherein the impeller is a plurality of impellers.

11. The pump assembly as set forth in claim 3, wherein the impeller is made of metal.

* * * * *